United States Patent [19]

Kubo

[11] Patent Number: 4,957,019

[45] Date of Patent: Sep. 18, 1990

[54] POWER TRANSMISSION DEVICE OF A PRESS MACHINE

[75] Inventor: Kazuo Kubo, Ishikawa, Japan

[73] Assignee: Kabushiki Kaisha Komatsu Seisakusho, Tokyo, Japan

[21] Appl. No.: 339,821

[22] PCT Filed: Apr. 28, 1988

[86] PCT No.: PCT/JP88/00433

§ 371 Date: Dec. 22, 1988

§ 102(e) Date: Dec. 22, 1988

[87] PCT Pub. No.: WO88/08342

PCT Pub. Date: Nov. 3, 1988

[30] Foreign Application Priority Data

Apr. 28, 1987 [JP] Japan ..... 62-105586

[51] Int. Cl.[5] ..... F16H 3/22; F16H 37/06

[52] U.S. Cl. ..... 74/665 H; 74/339; 74/350

[58] Field of Search ..... 74/339, 350, 423, 665 F, 74/665 H, 665 L, 665 M, 665 N, 866; 100/215, 218

[56] References Cited

U.S. PATENT DOCUMENTS 3,834,499 9/1974 Candellero et al. ..... 74/339 X
4,323,221 4/1982 Krober et al. ..... 74/350 X
4,389,865 6/1983 Davies ..... 74/665 N X
4,493,228 1/1985 Vukovich et al. ..... 74/866 X
4,504,753 3/1985 Koch ..... 74/665 L X
4,817,470 4/1989 Muller et al. ..... 74/339 X

FOREIGN PATENT DOCUMENTS 57-56528 4/1982 Japan .
58-58949 4/1983 Japan .
62-6932 1/1987 Japan .

*Primary Examiner*—Dwight Diehl
*Attorney, Agent, or Firm*—Diller, Ramik & Wight

[57] ABSTRACT

In a press machine provided with a power transmission device (1) for transmitting the driving force of the press body to a transfer feeder device, on the occasion of the recoupling of the power transmission device (1) at the exchange of a mold or the like, a motor (8) for rotating the shaft of the power transmission device (1) is driven in the forward or reverse direction so that the feeder angle (F) coincides with the crank angle (P) of the press. At the moment when the difference (P−F) between said angles enters within a predetermined range (A), the power transmission device (1) is coupled. Thus, it is possible to automatically couple the power transmission device simply and with high accuracy.

16 Claims, 5 Drawing Sheets

POWER TRANSMISSION DEVICE OF A PRESS MACHINE

BACKGROUND OF THE INVENTION

1. Field of the Invention

This invention relates to a power transmission device in a transfer press machine for transmitting the driving force of the press body side to the feeder device side, and more particularly relates to the coupling control of the power transmission device.

2. Description of the Prior Art

In a transfer press, there is provided a transfer feeder which carries workpieces to each working station. The transfer feeder usually obtains the driving force from the press body side via a power transmission device connecting between the press body and the transfer feeder, and, by this driving force, conveys workpiece by two-dimensionally or three-dimensionally moving transfer bars synchronizing with the movement of slides in the press body side.

In the above-described power transmission device, other than a mechanism which performs the synchronized operation of the press body and the transfer feeder by obtaining the driving force from the press body, there is provided a motor for independent operation so as to be able to independently operate only the transfer feeder.

Now, in a press machine provided with such a power transmission device, when a mold is exchanged, the coupling of the power transmission device is once released, and is coupled again after the completion of the exchange of the mold. Further, in this kind of device, in order to prevent mechanical damage due to the overload applied to the transfer feeder, the coupling of the power transmission device is automatically released when the overload is generated. The recoupling of the power transmission device becomes also necessary in such situation.

On the occasion of such a recoupling, when the locating between the shaft angle of the feeder side and the crank angle of the press is deviated, it becomes impossible to synchronize the transfer feeder with the press body. Hence, in the conventional device, the operator performs the following series of coupling operations.

(1) By operating a forward rotation/reverse rotation switch of the motor for the independent operation of the feeder, the operator adjusts the angle of the feeder-side shaft to the angle of the press body-side shaft with watching a display unit.

(2) When the above-described angles coincide with each other, the operator closes a coupling switch to recouple the power transmission device.

Thus, in the conventional device, in order to couple the power transmission device, it is necessary to perform troublesome operations relative to the adjustment of the angles of shafts or the like. Moreover, since the adjustment of angles is difficult, there is a problem in that only skilled operators who are aquainted with the movement of the machine can perform sure coupling.

The present invention takes into consideration such circumstances. It is an object of the present invention to provide a power transmission device of a press machine which can automatically couple a power transmission device with only excellent locating accuracy only by performing only simple operations.

SUMMARY OF THE INVENTION

In the present invention, there are provided a power transmission mechanism for coupling a press-side output shaft connected to a press body-side driving source and a power-delivering shaft connected to a feeder device, and transmitting the press-side power to the feeder device via these press-side output shaft and power-delivering shaft, a motor for driving the feeder device independently of the press body with transmitting the power to said power-delivering shaft through a course different from said power transmission mechanism, interrupting means for interrupting the power transmission by said power transmission mechanism, first detection means for detecting the rotating position of said press-side output shaft, second detection means for detecting the rotating position of said power-delivering shaft, and control means for taking in detected values of said first and second detection means when an instruction for coupling said power transmission mechanism is input, rotating said power-delivering shaft in the forward or reverse direction by driving said motor so that the difference between these detected values enters within a predetermined range, and coupling said power-delivering shaft to the press-side output shaft by driving said interrupting means when said difference enters within said range.

With such a configuration, when the power transmission device is coupled, the operator inputs the coupling instruction in the control means by, for example, closing a predetermined switch, or the like. By this input, the control means takes in the rotating position of the press-side output shaft and the rotating position of the power-delivering shaft detected by said first and second detection means. Then, the control means drives the motor for the independent operation of the feeder so that the difference between these detected values enters within a predetermined set range, and couples the power transmission device when the difference enters within said range. Thus, in the configuration of the present invention, all the coupling operations of the power transmission device are automatically performed.

When the speed of said motor is high, three set values having a relationship relative to the amount of set values, a first set value $<$ a second set value $<$ a third set value, have previously been set, relative to said set values of the control means. When an instruction for coupling said power transmission mechanism is input, the detected values of said first and second detection means are taken in. Then, said power-delivering shaft is rotated in the forward or reverse direction by driving said motor until the difference between these detected values becomes out of the range of said third set value. Further, said power-delivering shaft is rotated in the forward or reverse direction by driving said motor until said difference becomes within the range of said second set value. When said difference becomes within the range of said second set value, said motor is halted. On this occasion, when said difference comes within the range of said first set value, said power-delivering shaft is coupled to the press-side output shaft by driving said interrupting means. Thus, the locating accuracy can be improved with a simple method.

Thus, according to the present invention, a series of coupling operations are performed, by detecting the rotating positions of the press-side shaft and the feeder-side shaft of the power transmission device, performing locating by driving the motor for the independent operation of the feeder according to the detected value, and coupling the power transmission device after the completion of the locating. Hence, troublesome operations have disappeared, and even operators unfamiliar with the movement of the machine can surely perform coupling operations, and thereby it is possible to improve the efficiency in the mold-exchange operation or the like.

DESCRIPTION OF THE PREFERRED EMBODIMENTS

The present invention will be hereinafter explained in detail in accordance with an embodiment shown in the attached drawings.

Figure 1:
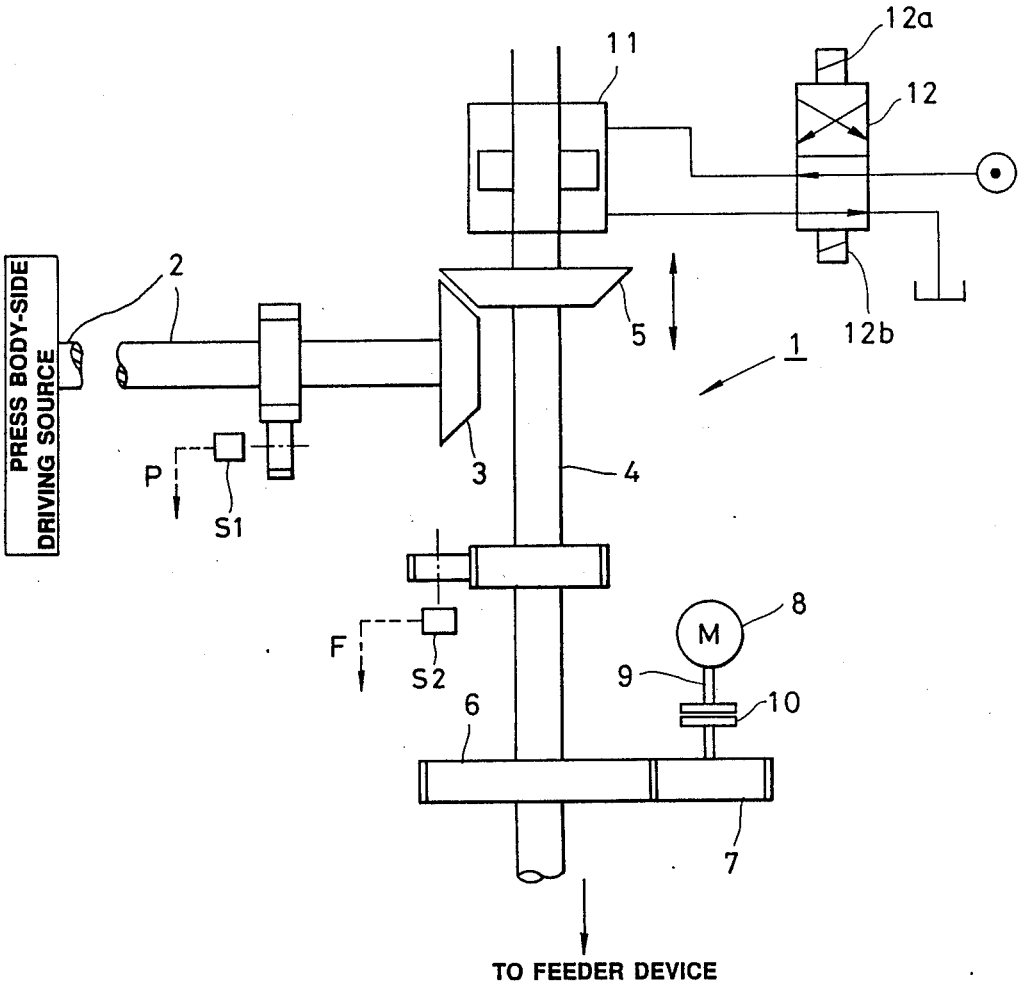
FIG. 1 is a schematic diagram showing an embodiment of the present invention.

FIG. 1 shows a schematic configuration of a power transmission device 1 according to the present invention. A bevel gear 3 is mounted to the front end of an output shaft 2 coupled to a press body-side driving source (unumbered). The bevel gear 3 meshes with a level gear 5 mounted to a power-delivering shaft 4.

A spur gear 6 is fixed at the lower end side of the power-delivering shaft 4, and is coupled to a rotating shaft 9 of a motor 8 for independent operation via a gear 7. A clutch 10 is provided for controlling the rotation of the shaft 9. At the upper end side of the power-delivering shaft 4, there is provided a hydraulic mechanism 11 for disengaging and engaging the gears 3 and 5 by moving the shaft 14 up and down. The hydraulic mechanism 11 is operated by the switching operation of a switching valve 12. The switching valve 12 switches the spool position by the action of solenoids **12*a* and 12*b* provided at both ends of a spool, and energizes the solenoid 12*b* when the power transmission device 1 is coupled to the driving source of the press body, and energizes the solenoid 12*a* when said device 1** is released from the driving source of the press body.

In this configuration, the driving force which is output from the output shaft 2 of the press body is transmitted to the power-delivering shaft 4 via the bevel gears 3 and 5, and is further transmitted to a transfer feeder (not illustrated) connected to the power-delivering shaft 4. As a result, the transfer feeder is operated synchronizing with the press body.

When the transfer feeder is independently operated without receiving the power from the press body side, the motor 8 for independent operation is driven, after the power transmission device 1 has been disconnected from the press body by switching the switching valve 12 to the release side.

Figure 2:
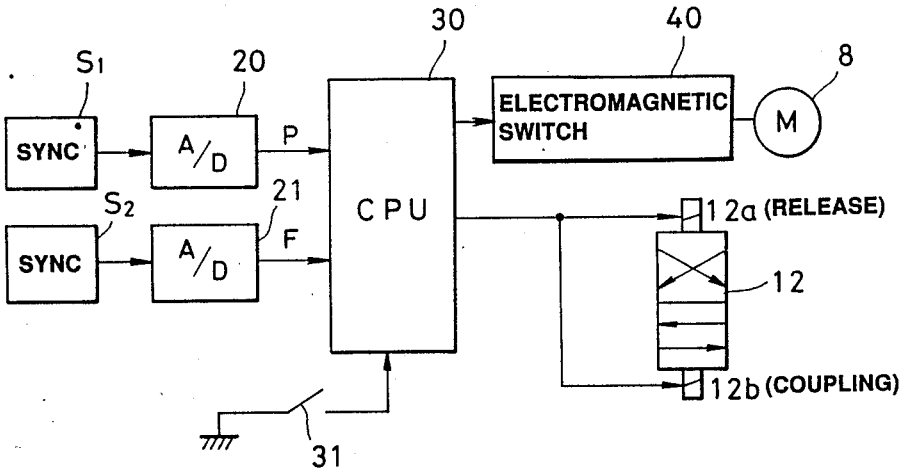
FIG. 2 is a block diagram showing an example of a control system in the embodiment.
Figure 3:
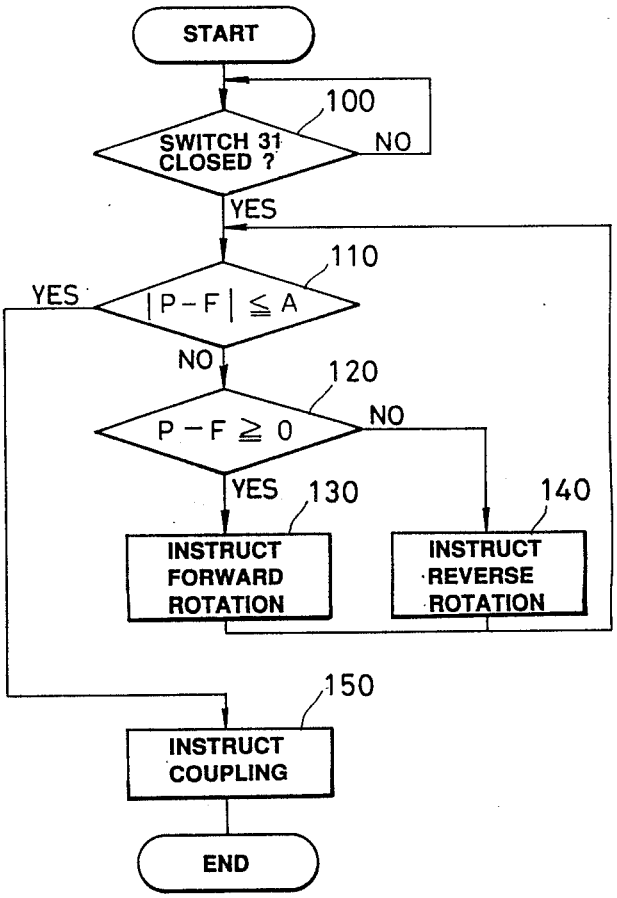
FIG. 3 is a flow chart showing an operational example of a CPU in the embodiment.

Now, in the configuration shown in FIG. 1, a synchro $S_1$ is provided at the output shaft 2 of the press body side, and a synchro $S_2$ is also provided at the power-delivering shaft 4. The rotation angle P of the output shaft 2 is detected by the synchro $S_1$, and the rotation angle F of the power-delivering shaft 4 is detected by the synchro $S_2$. The detected outputs of these synchros $S_1$ and $S_2$ are taken in a CPU 30 via A/D converters 20 and 21 as shown in FIG. 2. A coupling switch 31 is connected to the CPU 30. The coupling switch 31 is closed by the operator when the power transmission device 1 is coupled. The CPU 30 performs automatic coupling control as shown in FIG. 3, when the coupling switch 31 is closed.

That is, after the power transmission device 1 has once been disengaged by automatic release at the mold exchange or feeder overload, the output shaft 2 and the power-delivering shaft 4 halt at certain rotation angles P and F, respectively. When the coupling switch 31 is closed by the operator under this state (step 100), the CPU first takes in the detected values P and F of the sychros $S_1$ and $S_2$, and obtains the difference between these detected values. When the absolute value $|P-F|$ of the difference is outside of a predetermined range of angle A (step 110), the CPU 30 judges positive or negative of the difference (step 120). When $P-F \geqq 0$, the CPU 30 outputs the forward-rotation instruction to an electromagnetic switch 40 and rotates the motor 8 for independent operation in the forward direction (step 130). When $P-F<0$, the CPU 30 outputs the reverse-rotation instruction to the electromagnetic switch 40, and rotates the motor 8 in the reverse direction (step 140).

That is, when $P-F \geqq 0$, the output shaft 2 is advanced in phase with the power-delivering shaft 4. Hence, the phase of the power-delivering shaft 4 is advanced by rotating the motor 8 for independent operation in the forward direction. When $P-F<0$, the phase of the output shaft 2 is delayed. Hence, the phase of the power-delivering shaft 4 is delayed by rotating the motor 8 for independent operation in the reverse direction. Thus, the phases of the rotation angles of the both shafts are made coincident with each other. When it is detected that the phase difference $P-F$ between the two shafts enters within the above-described predetermined range of angle A by such control, the CPU immediately energizes the solenoid **12*b* of the switching valve 12, and couples the power transmission device 1 to the press body (step 150**).

Thus, in the present embodiment, when the coupling switch 31 is closed, automatic control is performed so that the feeder angle F coincides with the crank angle P of the press side by rotating the motor 8 for independent operation in the forward or reverse direction. Further, the power transmission device 1 is automatically coupled when the difference $P-F$ between the two angles enters within the predetermined range A. Hence, it is possible to perform the coupling operation with excellent accuracy with simple operations.

Figure 4:
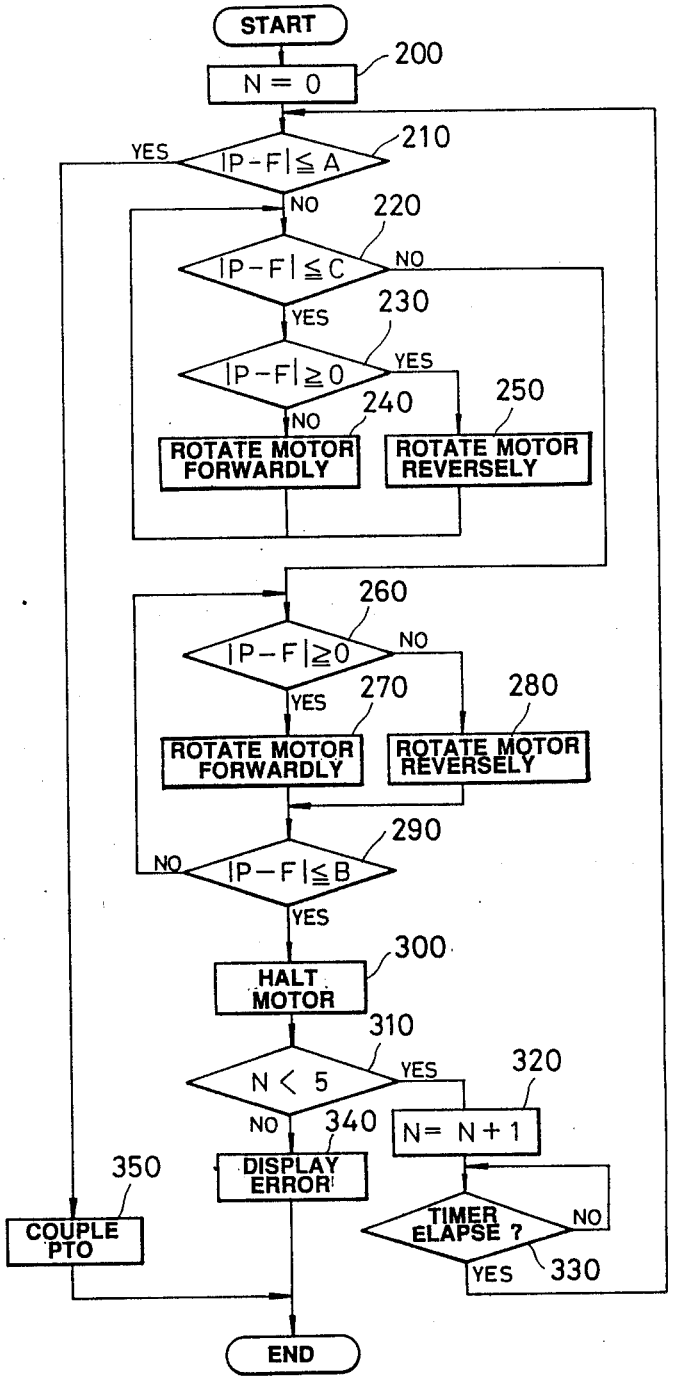
FIG. 4 is a flow chart showing another operational example of the embodiment.

FIG. 4 shows another embodiment of the present invention. In the embodiment shown in FIG. 4, it is supposed a case in which there is no speed switching of the motor 8 for the independent operation of the feeder, and the speed of the motor 8 is high.

Figure 5:
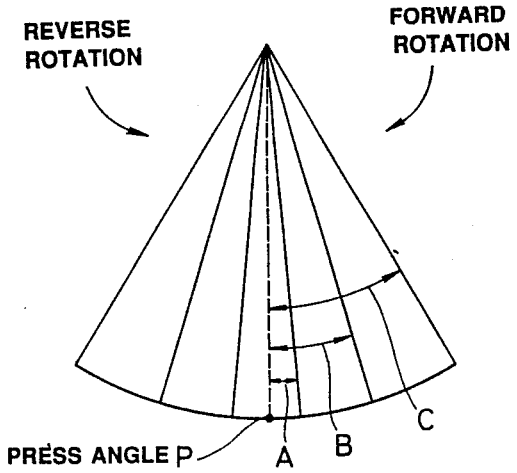
FIG. 5 is an explanatory diagram for explaining the operation in FIG. 4.

When the coupling switch 31 is closed, the CPU 30 first initializes the count value N of a built-in counter to 0 (step 200). The counter counts the trial frequency of the coupling processings. Then, the CPU 30 takes in the detected values P and F of the synchros $S_1$ and $S_2$, obtains the absolute value $|P-F|$ of the difference between these detection values, and judges whether this value is within the above-described range of angle A (see FIG. 5) or not (step 210). When $|P-F|>A$, the CPU 30 then judges whether the value $|P-F|$ is within a predetermined range C of the angle of relief (see FIG. 5) or not (step 220). In the case of $|P-F| \leqq C$ in this judgment, the CPU 30 investigates positive or negative of $P-F$ (step (230). When $P-F<0$, the CPU 30 outputs the forward-rotation instruction to the electromagnetic switch 40 and rotates the motor 8 for independent operation in the forward rotation (step 240). When $P-F \geqq 0$, the CPU 30 outputs the reverse-rotation instruction to the electromagnetic switch 40 and rotates the motor 8 for independent rotation in the reverse direction (step 250). By these forward and reverse operations, the feeder angle F is separated from the press angle until it once exceeds the angle of relief C.

When it is judged that $P-F>0$ at the step 220, the CPU 30 judges again positive or negative of $P-F$ (step 260), When $P-F \geqq 0$, the CPU 30 outputs the forward rotation instruction to the electromagnetic switch 40 and rotates the motor 8 for independent operation in the forward direction (step 270), When $P-F<0$, the CPU 30 outputs the reverse-rotation instruction to the electromagnetic switch 40 and rotates the motor 8 for independent operation in the reverse direction (step 280). Thereby, the feeder angle P is approached up to a predetermined coasting angle B (see FIG. 5).

The CPU 30 immediately outputs the halt instruction to the electromagnetic switch 40 at the moment when $|P-F| \leqq B$ is detected at step 290, and halts the motor 8 for independent operation (step 300). On this occasion, since the speed of the motor 8 is high, the motor 8 actually halts after having coasted some distance by inertia.

The CPU 30, after having halting the motor 8, then investigates the count value N (step 310). When $N<5$, the CPU 30 adds $+1$ to said count value N (step 320), and after waiting the lapse of a predetermined time referring to a built-in timer (step 330), investigates if $|P-F|$ enters within the predetermined set range A (step 210).

When $|P-F|$ is not within the predetermined set range A at the judgement of the step 210, the feeder angle P is separated again up to the angle of relief C, and then the same control as described above is repeated. The frequency of the repetitions is limited to five times. When $|P-F| \leqq A$ cannot be obtained by trials up to five times, error is displayed (step 340), and the operator is urged to modify the coasting angle B and the angle of relief C.

When it becomes $|P-| \leqq A$ at the above-described trial up to several times, the CPU 30 immediately energizes the solenoid **12*b* of the switching valve 12, and couples the power transmission device 1 to the press body (step 350**).

That is, in the embodiment shown in FIG. 4, on the occasion of adjusting the feeder angle F to the press angle P, when the difference $P-F$ is small, the feeder angle F is once separated up to the angle of relief C. Subsequently, the motor 8 is rotated in the direction so that these angles P and F come close to each other, and the motor 8 is halted at the moment when they come as close as up to the predetermined coasting angle B. By such control, it is possible to coincide the press angle P with the feeder angle F with excellent accuracy even when the speed of the motor is high.

Figure 6:
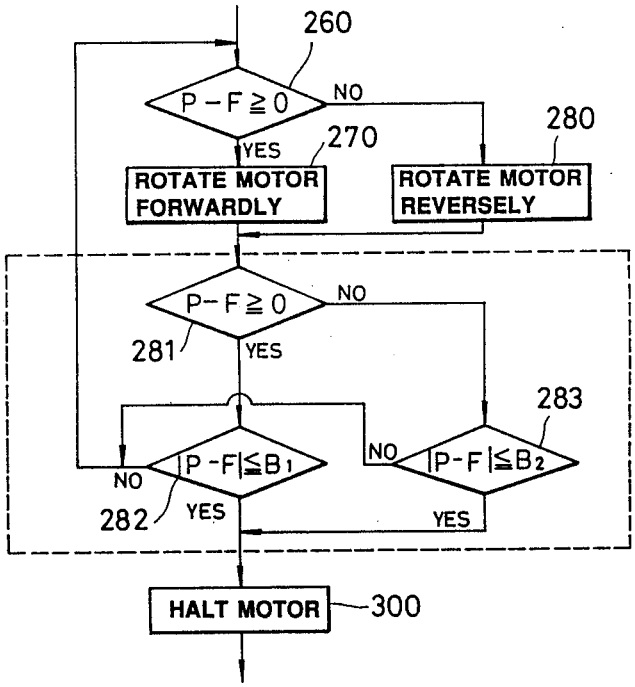
FIGS. 6 and 7 are flow charts in which a part of the flow chart in FIG. 4 is replaced by other steps.

Next, FIG. 8 shows still another embodiment. In this embodiment, the step 290 in FIG. 4 is replaced by steps 281 through 283 within broken lines in FIG. 6. That is, this embodiment deals with a case in which the load applied to the motor 8 is different at the forward rotation and at the reverse rotation, and the coasting angles to be set have different values, $B_1$ and $B_2$, in accordance with the forward rotation and the reverse rotation of the motor.

Now, in each of the embodiments described above, the coasting angle B and the angle of relief C are fixed values during plural trials of coupling, and the value B or C is properly modified by the operator when these plural trials have failed. In this case, no problem occurs when the press angle on the occasion of coupling is always in a fixed position. However, when the position of said press angle is not fixed, the load of the motor for independent operation for allowing the feeder angle approach said press angle in accordance with each press angle is, in some cases, different, and there occur cases in which several trials of couplings fail.

Figure 7:
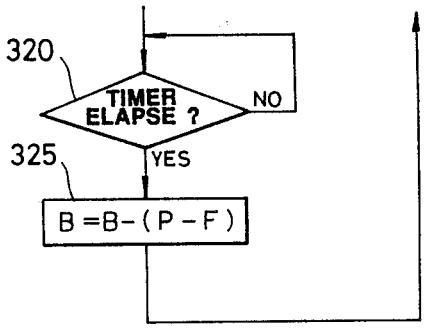

Hence, in the following embodiment, as shown in FIG. 7, step 325 which corrects the coasting angle B is added next to the step 320 in FIG. 4. That is, by correcting the coasting angle B according to the following formula:

$$B=B-(P-F),$$

the result of the present locating $(P-F)$ is subjected to feedback to the coasting angle B. Thus, in the present embodiment, the coasting angle B is corrected to a proper value every one trial. Hence, it is possible to reduce failed cases.

In the configuration shown in FIG. 1, the coupling and release operations of the power transmission device 1 are performed by moving up and down the power-delivering shaft 4 itself. However, another configuration may also be considered. For example, a clutch which is switched by a hydraulic cylinder may be provided between the output shaft 2 and the power-delivering shaft 4, and the coupling control of the power transmission device 1 may be performed by the switching of the clutch.

THE POSSIBILITIES OF THE INDUSTRIAL APPLICATIONS OF THE INVENTION

This invention is useful for a transfer press including a power transmission device which transmits the power of the press to a transfer feeder.

What is claimed is:

1. A power transmission device of a press machine comprising:

a power transmission mechanism for coupling a press-side output shaft connected to a press body-side driving source and a power-delivering shaft connected to a feeder device, and transmitting the power of the press body-side driving source to the feeder device via said press-side output shaft and power-delivering shaft;

a motor for transmitting power to said power-delivering shaft through a course which is different from said power transmission mechanism, and driving the feeder device independently of the press body-side driving source;

interrupting means for interrupting the power transmission by said power transmission mechanism;

first detection means for detecting the rotating position of said press-side output shaft;

second detection means for detecting the rotating position of said power-delivering shaft; and control means for receiving detected values of said first and second detection means when an instruction for coupling said power transmission mechanism is received from a switch, and rotating said power-delivering shaft in the forward or reverse direction by driving said motor so that a difference between said detected values enters within a predetermined range, and coupling said power-delivering shaft to the press-side output shaft by driving said interrupting means when said difference enters within said range.

2. A power transmission device of a press machine according to claim 1, wherein the press-side output shaft and the power-delivering shaft of said power transmission device makes a right angle, and said power transmission device transmits the rotation of the press-side output shaft to the power-delivering shaft by the coupling of a first bevel gear mounted to the press-side output shaft and a second bevel gear mounted to the power-delivering shaft.

3. A power transmission device of a press machine according to claim 2, wherein said interrupting means comprises a hydraulic mechanism for reciprocating said power-delivering shaft in the axial direction of the power-delivering shaft, and an electromagnetic direction-switching valve for switching the direction of oil supplied to the hydraulic mechanism, and engages and disengages said first and second bevel gears by the reciprocating movement of said power-delivering shaft.

4. A power transmission device of a press machine according to claim 1, wherein said first and second detection means are synchros.

5. A power transmission device of a press machine according to claim 1, wherein said control means comprises subtraction means for subtracting the detected value of the second detection means from the detected value of the first detection means, and means for rotating said motor in the forward direction when the arithmetic value of the subtraction means is positive, and rotating said motor in the reverse direction when said arithmetic value is negative.

6. A power transmission device of a press machine comprising:

a power transmission mechanism for coupling a press-side output shaft connected to a press body-side driving source and a power-delivering shaft connected to a feeder device, and transmitting the power of the press body-side driving source to the feeder device via said press-side output shaft and power-delivering shaft;

a motor for transmitting the power to said power-delivering shaft through a course which is different from said power transmission mechanism, and driving the feeder device independently of the press body-side driving source;

interrupting means for interrupting the power transmission by said power transmission mechanism;

first detection means for detecting the rotating position of said press-side output shaft;

second detection means for detecting the rotating position of said power-delivering shaft; and control means for receiving under the situation that three set values having a relationship relative a difference between the detected values of said first and second detection means, a first set value $<$ a second set value $>$ a third set value, having previously been set, the detected values of said first and second detection means when an instruction for coupling said power transmission mechanism is received from a switch rotating said power-delivering shaft in the forward or reverse direction by driving said motor until a difference between said detected values is out of the range of said third set value, subsequently rotating said power-delivering shaft in the forward or reverse direction by driving said motor until said difference is within the range of said second set value, halting said motor at the moment when said difference comes within the range of said second set value, and, when said difference comes within the range of said first set value, coupling said power-delivering shaft to the press-side output shaft by driving said interrupting means.

7. A power transmission device of a press machine according to claim 6, wherein said control means repeats, when said difference becomes out of the range of the first set value, a series of processings, from the processing of driving said motor until said difference becomes out of the range of said third set value to the processing of halting said motor, plural times until said difference becomes within the range of the first set value.

8. A power transmission device of a press machine according to claim 7, wherein, relative to said repetition frequency of said control means, the maximum frequency has previously been set.

9. A power transmission device of a press machine according to claim 8, wherein said control means corrects, when said difference has become out of the range of the first set value after the halt of the motor, said second set value by performing the feedback of said difference after the halt of the motor to said second set value, and uses said corrected second set value for the next processing.

10. A power transmission device of a press machine according to claim 7, wherein said control means corrects, when said difference has become out of the range of the first set value after the halt of the motor, said second set value by performing the feedback of said difference after the halt of the motor to said second set value, and uses said corrected second set value for the next processing.

11. A power transmission device of a press machine according to claim 6, wherein said control means performs a predetermined error display, when, after said motor has been halted, said difference becomes out of the range of said first set value.

12. A power transmission device of a press machine according to claim 6, wherein said control means compares said difference with the first set value after the lapse of a predetermined set time after the motor has been halted.

13. A power transmission device of a press machine according to claim 6, wherein, relative to the second set value of said control means, different set values are set corresponding to positive and negative values of said difference, respectively.

14. A power transmission device of a press machine according to claim 6, wherein the press-side output shaft and the power-delivering shaft of said power transmission device make a right angle, and said power transmission device transmits the rotation of the press-side output shaft to the power-delivering shaft by the coupling of a first bevel gear mounted to the press-side output shaft and a second bevel gear mounted to the power-delivering shaft.

15. A power transmission device of a press machine according to claim 14, wherein said interrupting means comprises a hydraulic mechanism for reciprocating said power-delivering shaft in the axial direction of the power-delivering shaft, and an electromagnetic direction-switching valve for switching the direction of oil supplied to the hydraulic mechanism, and engages and disengages said first and second bevel gears by the reciprocating movement of said power-delivering shaft.

16. A power transmission device of a press machine according to claim 6, wherein said first and second detection means are synchros.

* * * * *